US008481172B2

(12) United States Patent
Warnecke et al.

(10) Patent No.: US 8,481,172 B2
(45) **Date of Patent: *Jul. 9, 2013**

(54) STEEL SHEET PRODUCT PROVIDED WITH AN ANTICORROSION COATING AND PROCESS FOR PRODUCING IT

(75) Inventors: Wilhelm Warnecke, Hamminkeln (DE); Manfred Meurer, Rheinberg (DE); Rudolf Schönenberg, Hemer (DE); Michael Keller, Freudenberg (DE); Alexander Elsner, Olpe (DE)

(73) Assignee: ThyssenKrupp Steel AG, Duisburg (DE)

( * ) Notice: Subject to any disclaimer, the term of this patent is extended or adjusted under 35 U.S.C. 154(b) by 663 days.

This patent is subject to a terminal disclaimer.

(21) Appl. No.: 12/300,968

(22) PCT Filed: May 15, 2007

(86) PCT No.: PCT/EP2007/054711

§ 371 (c)(1),
(2), (4) Date: Sep. 3, 2009

(87) PCT Pub. No.: WO2007/132007

PCT Pub. Date: Nov. 22, 2007

(65) Prior Publication Data

US 2010/0024925 A1 Feb. 4, 2010

(30) Foreign Application Priority Data

May 15, 2006 (EP) ..... 06113962

(51) Int. Cl.

| | |
|---|---|
| ***C23C 2/02*** | (2006.01) |
| ***C23C 2/04*** | (2006.01) |
| ***B05D 3/02*** | (2006.01) |
| ***B05D 1/18*** | (2006.01) |
| ***B32B 15/04*** | (2006.01) |
| ***B32B 15/18*** | (2006.01) |
| ***B32B 15/20*** | (2006.01) |

(52) U.S. Cl.

USPC ..... 428/659; 428/336; 428/340; 428/219; 148/533; 427/383.7; 427/433

(58) Field of Classification Search

USPC ..... 428/658, 659, 681, 684, 685, 332, 428/334, 335, 336, 340, 213, 215, 219

See application file for complete search history.

(56) References Cited

U.S. PATENT DOCUMENTS

| | | | |
|---|---|---|---|
| 4,057,424 | A | 11/1977 | Bruno et al. |
| 4,369,211 | A | 1/1983 | Nitto et al. |

(Continued)

FOREIGN PATENT DOCUMENTS

| | | |
|---|---|---|
| EP | 0 038 904 | 10/1985 |
| EP | 1 439 240 | 7/2004 |

(Continued)

OTHER PUBLICATIONS

International Search Report for International Application No. PCT/EP2007/054711, (Dec. 2008).

(Continued)

*Primary Examiner* — Michael La Villa
(74) *Attorney, Agent, or Firm* — The Webb Law Firm

(57) ABSTRACT

A flat steel product, and a method for its production, which is formed from a steel substrate, such as strip or sheet steel, and a zinc-based corrosion protection coating, applied to at least one side of the steel substrate, which contains (in wt. %) Mg: 0.25 to 2.5%, Al: 0.2 to 3.0%, Fe: ≦4.0%, and optionally in total up to 0.8% of one or more elements of the group Pb, Bi, Cd, Ti, B, Si, Cu, Ni, Co, Cr, Mn, Sn and rare earths, remainder zinc and unavoidable impurities are described. The corrosion protection coating has an Al content of maximum 0.5 wt. % in an intermediate layer extending between a surface layer directly adjacent to the surface of the flat steel product and a border layer adjacent to the steel substrate and with a thickness amounting to at least 20% of the total thickness of the corrosion protection coating.

21 Claims, 2 Drawing Sheets

U.S. PATENT DOCUMENTS

| | | | | |
|---|---|---|---|---|
| 4,401,727 | A | 8/1983 | Berke et al. | |
| 4,812,371 | A | 3/1989 | Shindou et al. | |
| 6,177,140 | B1 | 1/2001 | Patil et al. | |
| 6,465,114 | B1 | 10/2002 | Honda et al. | |
| 6,902,829 | B2 | 6/2005 | Pradhan et al. | |
| 2008/0142125 | A1 * | 6/2008 | Meurer et al. | 148/533 |
| 2010/0055344 | A1 * | 3/2010 | Ostwald et al. | 427/558 |

FOREIGN PATENT DOCUMENTS

| | | | |
|---|---|---|---|
| EP | 1 621 645 | | 2/2006 |
| EP | 1 693 477 | * | 8/2006 |
| GB | 2 110 248 | | 6/1983 |
| JP | 02 285057 | | 11/1990 |
| JP | 9 143 658 | | 6/1997 |
| JP | 11 140 614 | | 5/1999 |
| JP | 2000/160315 | | 6/2000 |
| WO | WO 89/09844 | | 10/1989 |
| WO | WO 98/24857 | | 6/1998 |
| WO | WO 2004/063294 | | 7/2004 |
| WO | WO 2006/089854 | * | 8/2006 |

OTHER PUBLICATIONS

Non-final Office Action to co-pending U.S. Appl. No. 12/300,966 dated Aug. 17, 2011, 10 pages.

* cited by examiner

STEEL SHEET PRODUCT PROVIDED WITH AN ANTICORROSION COATING AND PROCESS FOR PRODUCING IT

CROSS-REFERENCE TO RELATED APPLICATIONS

This application is a national phase application of international application no. PCT/EP2007/054711, filed on May 15, 2007, which claims the benefit of and priority to European patent application no. EP 06 113 962.2, filed May 15, 2006. The disclosures of the above applications are incorporated herein by reference in their entireties.

FIELD OF THE INVENTION

The invention concerns a flat steel product which is formed from a steel substrate, such as strip or sheet steel, and a zinc-based corrosion protection coating applied to at least one side of the steel substrate. In addition the invention concerns a method with which such flat steel products can be produced.

BACKGROUND

To improve the corrosion resistance, metal coatings are applied to sheet or strip steel which in most applications are based on zinc or zinc alloys. Such zinc or zinc alloy coatings, because of their barrier and cathodic protective effect, provide good corrosion protection in practical use for the correspondingly coated sheet steel.

The thickness of the coating required for adequate corrosion resistance in the prior art however causes problems in processing i.e. when forming and welding. This applies for example when in practical use flanges subject to high corrosion load are to be spot-welded. This requirement exists in particular in the field of car body construction, in general building applications or in the construction of housings for domestic appliances. The connection produced by such welding, for an adequate welding current, must have a minimum spot diameter of $4\times\sqrt{t}$(t=individual sheet thickness) and be able to be welded without spatter.

In the context of the problems in processing conventional sheets coated with a relatively thick Zn layer, highly corrosion-resistant Zn—Mg or Zn—Mg—Al layer systems have been developed which, with a greatly reduced layer thickness, offer corrosion protection comparable to that of a conventional 7.5 μm thick zinc coating but are significantly easier to process.

One possibility for producing such hot galvanised sheet steel with increased corrosion resistance and simultaneously reduced coating mass is described in EP 0 038 904 B1. A zinc coating containing 0.2 wt. % Al and 0.5 wt. % Mg is applied to a steel substrate by hot dip coating. Although the metal coated in this way has improved resistance to rust formation, in practice it does not fulfil the requirements imposed today for corrosion resistance of such panels, in particular in the area of connecting flanges of a car body.

A further sheet provided with a metallic protective coating with increased corrosion resistance is known from EP 1 621 645 A1. The sheet steel described there is coated, by conventional hot galvanising, with a protective coating which contains (in wt. %) 0.3 to 2.3% Mg, 0.6 to 2.3% Al, optionally <0.2% other active constituents and the remainder zinc and unavoidable impurities. Due to the high proportion of Al and Mg, such metal has particularly good resistance to corrosion. Practical tests however have shown that even the panels produced according to EP 1 621 645 A1 do not fulfil the requirements imposed by the processing industry for the weldability of such panels. It is also shown that the panels concerned have a phosphatisation capacity which is inadequate according to present standards.

SUMMARY OF THE INVENTION

The invention, in one embodiment, features a sheet steel product which has an optimum combination of high corrosion resistance and optimised processability and which is suitable in particular for use as a material for car body construction, for general building purposes or for domestic appliance construction. Also described is a method for producing such a flat product.

The invention features a flat steel product which is formed from a steel substrate, such as strip or sheet steel, and a zinc-based corrosion protection coating applied to at least one side of the steel substrate, which contains (in wt. %) 0.25 to 2.5% Mg, 0.2 to 3.0% Al, ≦4.0% Fe and optionally in total up to 0.8% of one or more elements from the group Pb, Bi, Cd, Ti, B, Si, Cu, Ni, Co, Cr, Mn, Sn and rare earths, remainder zinc and unavoidable impurities, wherein the corrosion protection coating has an Al content of maximum 0.5 wt. % in an intermediate layer extending between a surface layer directly adjacent to the surface of the flat steel product and a border layer adjacent to the steel substrate and with a thickness amounting to at least 20% of the total thickness of the corrosion protection coating.

Furthermore, the invention features a method for producing a flat steel product in which a corrosion protection coating is applied to a steel substrate such as strip or sheet steel, in that the steel substrate is annealed and starting from the annealing temperature cooled to a strip inlet temperature of 400 to 600° C., at which the steel substrate enters a melt bath containing (in wt. %) 0.1 to 0.4% Al, 0.25 to 2.5% Mg, up to 0.2% Fe, remainder zinc and unavoidable impurities, and heated to a bath temperature of 420 to 500° C., where the difference between the strip immersion temperature and the bath temperature varies in the range from −20° C. to +100° C., so that on the steel substrate a corrosion protection coating is formed which contains (in wt. %) 0.25 to 2.5% Mg, 0.2 to 3.0% Al, ≦4.0% Fe, and optionally in total up to 0.8% of one or more elements from the group Pb, Bi, Cd, Ti, B, Si, Cu, Ni, Co, Cr, Mn, Sn and rare earths, remainder zinc and unavoidable impurities, and which has an Al content of maximum 0.5 wt. % in an intermediate layer extending between a surface layer directly adjacent to the surface of the flat steel product and a border layer adjacent to the steel substrate and with a thickness amounting to at least 20% of the total thickness of the corrosion protection coating.

The invention is based, at least in part, on the knowledge that general properties, such as, e.g., adhesion and weldability of a steel sheet or strip with a Zn—Mg—Al coating as protection against corrosion, depend decisively on the distribution of the aluminium in the coating layer. It has been found surprisingly that if, as specified by the invention, low Al contents are present in an intermediate layer, close to the surface, of sufficient thickness, the weldability improves in comparison with conventionally formed sheets even though the Al content of the coating as a whole is at a level which guarantees a high corrosion protection. The sheets formed with a high Al concentration in the area of the border layer at the transition to the steel substrate, retain the positive effect of the aluminium on the corrosion protection despite the low proportion of Al in the intermediate layer.

Flat steel products formed, as a result of the low content of Al on their surface and in the intermediate layer, are particularly suitable for phosphatising so that for example they can be given an organic paint coating without special additional measures. Elements from the group Pb, Bi, Cd, Ti, B, Si, Cu, Ni, Co, Cr, Mn, Sn and rare earths can be present up to a total of their contents of 0.8 wt. % in the coating. Pb, Bi and Cd can serve to form a larger crystal structure (flowers of zinc), Ti, B, Si to improve formability, Cu, Ni, Co, Cr, Mn to influence the border layer reactions, Sn to influence the surface oxidation and rare earths, in particular lanthanum and cerium, to improve the flow behaviour of the melt. The impurities which may be present in a corrosion protection coating can include the constituents which, as a result of the hot dip coating, transfer from the steel substrate to the coating in quantities which do not affect the properties of the coating.

It has been shown that with the relatively low Al content of a melt bath used for performance of the method according to the invention, by suitable setting of the strip immersion and/or bath temperature, even the nature of the layer structure desired can be directly influenced. High Al and Mg contents are enriched in the border layer adjacent to the steel substrate, whereas in the intermediate layer in particular low Al contents are present. The difference between the strip temperature on immersion and the temperature of the melt bath is particularly significant. As this difference varies in the range from −20° C. to 100° C., preferably −10° C. to 70° C., the presence of Al minimised in the intermediate layer can be set securely and in a targeted manner.

Particularly favourable welding properties occur when the aluminium content of the intermediate layer is reduced as far as possible. Therefore an advantageous embodiment of the invention allows for the Al content of the intermediate layer to be restricted to 0.25 wt. %.

In addition the layer structure used by the invention has a particularly positive effect on the weldability and phosphatising capacity, while still retaining the good corrosion protection effect of the coating, when the thickness of the intermediate layer amounts to at least 25% of the total thickness of the corrosion protection coating. The figures given here and in the claims for the structure of the corrosion protection coating and its individual layers relate to a layer profile determined by means of a GDOS measurement (glow discharge optical emission spectrometry).

The GDOS measurement method described for example in the VDI Glossary of Materials Technology, published by Hubert Gräfen, VDI Verlag GmbH, Düsseldorf 1993 is a standard method for fast detection of a concentration profile of coatings.

With the flat steel profiles produced, such a GDOS measurement shows that in the surface layer immediately adjacent to the surface of the coating, as a result of oxidation due to production, inevitably an increased Al content is produced. As the thickness of this surface layer is however very low compared with the total thickness of the coating, on welding of a flat steel product the surface layer is easily punctured and only insignificantly influences the welding result. In order to exclude any possible negative effect of the surface coating with high Al content, the thickness of the surface coating should be restricted to less than 10%, in particular less than 1% of the total thickness of the corrosion protection coating. Practical tests have confirmed that with flat steel products, the surface layer is maximum 0.2 μm thick so that with conventional coating thicknesses of 6 μm and more, the proportion of surface border layer in the total thickness of the coating structure is around 3.5% or considerably less.

With flat steel products, the coating preferably has Fe contents which amount to more than 0.3 wt. %, in particular more than 0.4 wt. % and even more than 0.5 wt. %. The relatively high Fe contents are present in particular in the area of the border layer adjacent to the steel substrate. Here preferably an alloy is formed which guarantees an optimised adhesion of the coating to the steel substrate. In this way a flat steel product has usage properties which are superior to those of conventional flat steel products if the protective coating has high Mg and Al contents.

In addition to the layer structure of the corrosion protection coating, to optimise further the weldability and phosphatisation capacity of a flat steel product, the Al content of the corrosion protection coating can be restricted to less than 0.6 wt. %, in particular less than 0.5 wt. %.

To secure its effect, the total thickness of the corrosion protection coating should be at least 2.5 μm, in particular at least 7 μm. The coating mass distribution of the corrosion protection coating of at least 100 g/m$^2$ has proved particularly favourable with regard to protective effect.

Despite higher coating masses and thickness of the corrosion protection coating, because of the distribution of the Al content, the weldability is not adversely affected.

Particularly good product results are achieved if the bath temperature of the melt bath is 440 to 480° C.

Surprisingly it has been found that the speed with which the steel substrate passes through the melt bath only has a secondary influence on the coating result. Therefore for example this can be varied within the range from 50 to 200 m/min in order to achieve the optimum working result with maximum productivity.

The annealing of the steel strip prior to the melt bath should be carried out under an inert gas atmosphere in order to avoid oxidation of the metal surface. The inert gas atmosphere in the known manner can contain more than 3.5 vol. % $H_2$ and the remainder $N_2$. The annealing temperature can also lie in the range from 700 to 900° C. in the known manner.

The deviation, in the range from −20° C. to +100° C., of the bath inlet temperature of the steel substrate from the temperature of the melt bath ensures that the melt bath retains its optimum temperature evenly despite the introduction of the steel substrate.

The melt bath itself preferably contains only traces of iron since the Fe content of the corrosion protection coating is to be set by the inclusion of iron from the steel substrate. Consequently the Fe content of the melt bath is preferably restricted to maximum 0.1 wt. %, in particular maximum 0.07 wt. %.

The good processability, the simultaneously good corrosion protection and good phosphatisation capacity exist irrespective of the nature and composition of the steel substrate. Practical tests have shown that there are no substantial differences in the properties of the flat steel products produced according to the invention if the substrate comprises an IF steel, for example a conventional micro-alloy steel, or a normal alloy steel such as a conventional high-grade steel.

BRIEF DESCRIPTION OF THE DRAWINGS

The invention is now described below with reference to embodiment examples.

DESCRIPTION OF THE INVENTION

To produce specimens of flat steel products with high corrosion resistance, which can be easily spot welded and phosphatised, a steel strip serving as a steel substrate is annealed under a nitrogen atmosphere containing 5% $H_2$ with dew point −30° C.±2° C. for a holding time of 60 s in each case. The annealing temperature was 800° C. with a heating rate of 110° C./s.

After annealing, the steel strip was rapidly cooled with a cooling rate of 5 to 30° C./s to a temperature of 470° C.±5° C. at which it was held for 30 s. The steel strip was then introduced at a strip immersion speed of 100 m/min into a melt bath with bath temperature 460° C.±5° C. The bath inlet temperature of the steel strip was 5° C. above the bath temperature of the melt bath.

The respective composition of the melt bath and the analyses of the specimens, passing through the hot galvanising in the melt bath on the upper and lower sides of the corrosion protection coating, are shown in Table 1 for twelve specimens E1 to E12 coated in the manner described above, where determined. It is found that the coatings formed on the steel substrate have high proportions of Fe. The alloying with Fe which occurs during production of the coating ensures a particularly high adhesion capacity of the coating to the steel substrate.

Figure 1:
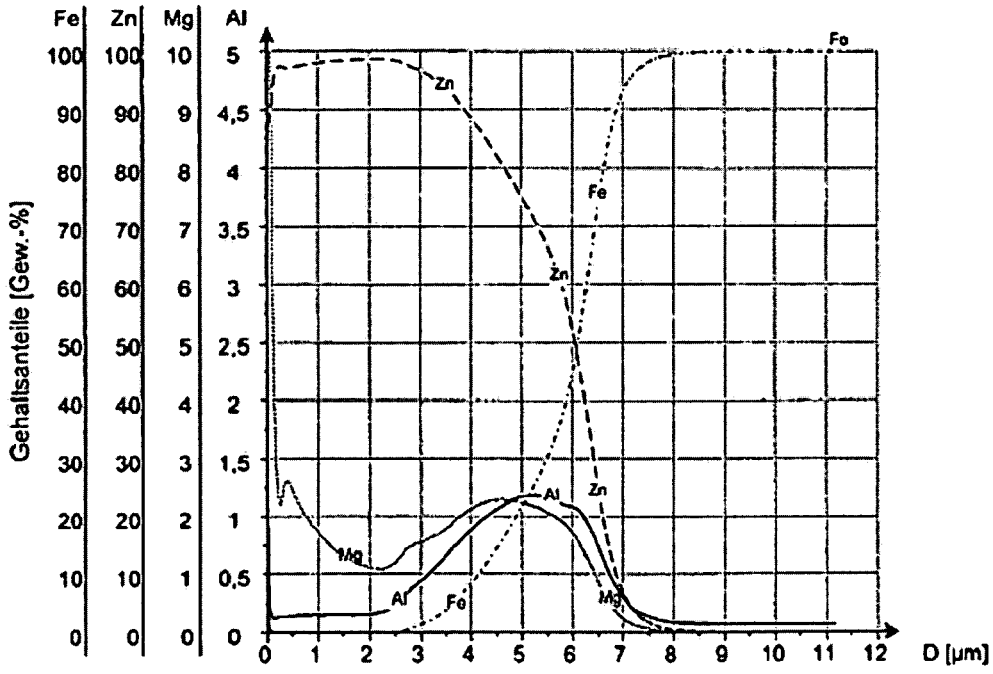
FIG. 1 shows the graphic depiction of the distribution obtained by GDOS measurement of the contents of Zn, Mg, Al and Fe over the thickness of a first corrosion protection coating applied to a steel substrate.
Figure 2:
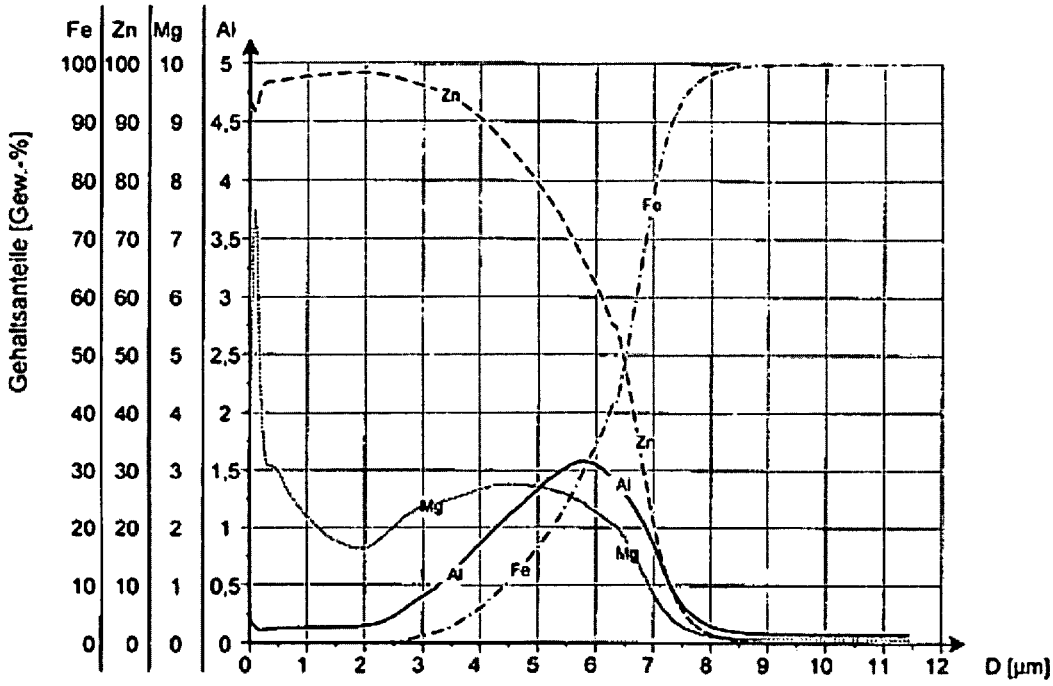
FIG. 2 shows the graphic depiction of the distribution obtained by GDOS measurement of the contents of Zn, Mg, Al and Fe over the thickness of a second corrosion protection coating applied to a steel substrate.

In addition, analyses of the distribution of the contents of Zn, Al, Mg and Fe over the thickness of the corrosion protection coating formed in each case on the steel substrate have shown that the Al content of the coating is in each case less than 0.2% in an intermediate layer close to the surface, the thickness of which amounts to more than 25% of the layer thickness (total thickness) of the coating in each case. The corresponding distribution over the thickness D (surface D=0 μm) is shown graphically for specimens E1 and E2 in FIGS. 1 and 2.

The figures show that, at the surface of the coating concerned, a surface border layer has formed with an Al content which is high as a result of oxidation. The thickness of this surface border layer is however maximum 0.2 μm and it is therefore easily punctured on spot or laser welding with no deterioration in the quality of the welding result.

Next to the surface border layer is an intermediate layer approximately 2.5 μm thick, the Al content of which is less than 0.2%. The thickness of the intermediate layer is therefore around 36% of the total layer thickness of the respective corrosion protection coating of 7 μm.

The intermediate layer transforms into a border layer next to the steel substrate in which the content of Al, Mg and Fe is substantially higher in relation to the corresponding contents of the intermediate layer.

To check the dependency of the layer structure and the composition of a corrosion coating on the steel substrate processed in each case and on the bath inlet and outlet temperature, based on a conventional micro-alloy steel IF and an equally conventional high-grade steel QS, further specimens E13 to E22 were produced with a corrosion protection coating in a laboratory test. The composition of steels IF and QS is given in Table 3.

The operating parameters set in the laboratory tests and an analysis of the coating layer generated accordingly are shown in Table 2. It is found that the result of the coating, in particular with regard to the inclusion of high Fe contents arising from the steel substrate and the formation of the intermediate layer close to the surface with an Al content of less than 0.25% wt. %, is independent of the composition of the steel substrate.

In total, tests performed on specimens E1 to E22 have confirmed that with the corrosion protection coating, in the surface border layer immediately adjacent to the surface of the coating, the elements Mg and Al are present in enriched form as oxides. In addition, Zn oxide is present at the surface.

In addition, operating tests B1 to B19 have been performed in which the steel substrate was steel strips comprising high-grade steel QS. The operating parameters set, the respective melt bath composition and an analysis of the corrosion protection layer obtained on the steel substrate in each case, are given in Table 4.

The operating tests confirmed in full the result of the preceding laboratory tests. The thickness of the surface border layer absorbing the superficial oxidation in the specimens studied amounts to maximum 0.2 μm and in relation to the layer profile determined by GDOS measurement lies in the range of up to 2.7% of the total layer thickness. The amount of Al enrichment at the immediate surface is maximum approximately 1 wt. %. This is followed, up to a thickness of at least 25% of the total thickness of the coating, by the intermediate layer with a low Al content of maximum 0.25 wt. %. In the border layer then the Al content rises to 4.5% at the border to the steel substrate. The Mg enrichment at the immediate surface of the coating is clearly greater than the Al enrichment. Here, Mg proportions of up to 20% are achieved. Thereafter, the Mg proportion diminishes over the intermediate layer and at a depth of around 25% of the total layer thickness of the coating amounts to 0.5 to 2%. Over the border layer there is a rise in the Mg content in the direction of the steel substrate. At the border to the steel substrate the Mg coating amounts to 3.5%.

TABLE 1

| | Melt Bath | | | Layer Analysis Top | | | | | Layer Analysis Underside | | | | |
|---|---|---|---|---|---|---|---|---|---|---|---|---|---|
| Specimen | Al | Fe | Mg | Al | Fe | Mg | Coating mass g/m² | Coating Thickness μm | Al | Fe | Mg | Coating mass g/m² | Coating Thickness μm |
| | | % *) | | | % *) | | | | | % *) | | | |
| E1 | 0.201 | 0.011 | 1.589 | 1.16 | 1.06 | 1.52 | 41.5 | 7.0 | n.d. | n.d. | n.d. | n.d. | 9.0 |
| E2 | 0.205 | 0.090 | 2.024 | 1.18 | 1.07 | 1.90 | 40.5 | 7.0 | n.d. | n.d. | n.d. | n.d. | 8.5 |
| E3 | 0.189 | 0.021 | 0.733 | 0.47 | 0.37 | 0.75 | 75.9 | 10.6 | n.d. | n.d. | n.d. | n.d. | 7.7 |
| E4 | 0.189 | 0.021 | 0.733 | 0.66 | 0.58 | 0.75 | 50.0 | 6.7 | 1.61 | 1.69 | 0.77 | 17.6 | 2.1 |
| E5 | 0.202 | 0.013 | 0.790 | 1.38 | 1.37 | 0.76 | 20.7 | 4.0 | n.d. | n.d. | n.d. | n.d. | 2.9 |
| E6 | 0.209 | n.d. | 0.825 | 0.63 | 0.55 | 0.81 | 47.8 | n.d. | 0.71 | 0.61 | 0.82 | 43.5 | n.d. |
| E7 | 0.218 | n.d. | 0.498 | 0.87 | 0.8 | 0.48 | 37.4 | n.d. | 1.22 | 1.25 | 0.48 | 24.4 | n.d. |
| E8 | 0.218 | n.d. | 0.498 | 0.69 | 0.57 | 0.47 | 57.3 | n.d. | 1.19 | 1.11 | 0.48 | 30.1 | n.d. |
| E9 | 0.231 | n.d. | 1.265 | 1.16 | 1.13 | 1.29 | 35.1 | n.d. | 1.96 | 2.15 | 1.29 | 20.0 | n.d. |

TABLE 1-continued

| Specimen | Melt Bath Al | Melt Bath Fe % *) | Melt Bath Mg | Layer Analysis Top Al | Layer Analysis Top Fe % *) | Layer Analysis Top Mg | Layer Analysis Top Coating mass g/m² | Layer Analysis Top Coating Thickness µm | Layer Analysis Underside Al | Layer Analysis Underside Fe % *) | Layer Analysis Underside Mg | Layer Analysis Underside Coating mass g/m² | Layer Analysis Underside Coating Thickness µm |
|---|---|---|---|---|---|---|---|---|---|---|---|---|---|
| E10 | 0.231 | n.d. | 1.265 | 1.12 | 1.11 | 1.24 | 28.7 | n.d. | 1.35 | 1.42 | 1.24 | 21.4 | n.d. |
| E11 | 0.196 | n.d. | 0.288 | 1.65 | 1.94 | n.d. | 27.3 | n.d. | 2.96 | 3.88 | 0.27 | 14.6 | n.d. |
| E12 | 0.200 | 0.011 | 0.297 | 1.02 | 1.09 | n.d. | 43.2 | n.d. | 0.59 | 0.62 | 0.27 | 83.8 | n.d. |

*) Remainder Zn and unavoidable impurities;
n.d. = not determined.

TABLE 2

| Specimen | Steel | Annealing Temp [° C.] | Bath Inlet Temp [° C.] | Bath Temp [° C.] | Coating mass [g/m²] | Al | Fe [%] | Mg | Al | Fe [g/m²] | Mg |
|---|---|---|---|---|---|---|---|---|---|---|---|
| E13 | IF | 800 | 445 | 440 | 51.6 | 0.52 | 0.36 | 1.21 | 0.27 | 0.19 | 0.62 |
| E14 | QS | 800 | 445 | 440 | 55.9 | 0.56 | 0.40 | 1.16 | 0.31 | 0.22 | 0.65 |
| E15 | IF | 800 | 465 | 460 | 64.3 | 0.81 | 0.75 | 1.15 | 0.52 | 0.48 | 0.74 |
| E16 | QS | 750 | 465 | 460 | 54.1 | 0.98 | 0.84 | 1.21 | 0.53 | 0.45 | 0.65 |
| E17 | IF | 800 | 485 | 460 | 49.4 | 1.08 | 0.97 | 1.18 | 0.53 | 0.48 | 0.58 |
| E18 | QS | 750 | 485 | 460 | 55.1 | 0.97 | 0.84 | 1.19 | 0.53 | 0.46 | 0.66 |
| E19 | IF | 800 | 500 | 460 | 54.3 | 1.14 | 1.08 | 1.20 | 0.62 | 0.59 | 0.65 |
| E20 | QS | 750 | 500 | 460 | 36.7 | 1.50 | 1.41 | 1.19 | 0.55 | 0.52 | 0.44 |
| E21 | IF | 800 | 485 | 480 | 62.4 | 1.15 | 1.26 | 1.15 | 0.72 | 0.79 | 0.72 |
| E22 | QS | 750 | 485 | 480 | 43.6 | 1.57 | 1.68 | 1.16 | 0.68 | 0.73 | 0.51 |

TABLE 3

| Steel | C | Si | Mn | P [wt.-%] | S | Ti | Al |
|---|---|---|---|---|---|---|---|
| IF | 0.003 | 0.02 | 0.13 | 0.010 | 0.012 | 0.07 | 0.03 |
| QS | 0.07 | 0.04 | 0.40 | 0.012 | 0.005 | 0.005 | 0.04 |

Remainder iron and unavoidable impurities

The invention claimed is:

1. A flat steel product which is formed from a steel substrate and a zinc-based corrosion protection coating applied to at least one side of the steel substrate, which contains in (wt. %):

Mg: 0.25 to 2.5%

Al: 0.2 to 3.0%

Fe: 0.3 to 4.0%

TABLE 4

| Test | Strip immersion temp BET | Bath Temp BT [° C.] | Difference BET-BT | Coating Thickness [µm] | Coating mass [g/m²] | Al [wt. %] *) | Fe [wt. %] *) | Mg [wt. %] *) | Al [g/m²] | Fe [g/m²] |
|---|---|---|---|---|---|---|---|---|---|---|
| B1 | 516 | 466 | 50 | 4.9 | 34.7 | 1.61 | 1.46 | 0.81 | 0.56 | 0.51 |
| B2 | 536 | 478 | 58 | 7.8 | 55.1 | 1.00 | 0.88 | 0.82 | 0.55 | 0.48 |
| B3 | 500 | 472 | 28 | 11.4 | 80.6 | 0.65 | 0.51 | 0.82 | 0.52 | 0.41 |
| B4 | 522 | 472 | 50 | 10.2 | 72.1 | 0.94 | 0.82 | 0.81 | 0.68 | 0.59 |
| B5 | 493 | 467 | 26 | 5.7 | 40.2 | 0.66 | 0.47 | 0.81 | 0.27 | 0.19 |
| B6 | 457 | 456 | 1 | 11.2 | 79.2 | 0.43 | 0.20 | 0.81 | 0.34 | 0.15 |
| B7 | 483 | 464 | 19 | 4.8 | 34.4 | 0.97 | 0.92 | 0.83 | 0.33 | 0.32 |
| B8 | 509 | 466 | 43 | 9.2 | 65.5 | 0.72 | 0.61 | 0.81 | 0.47 | 0.40 |
| B9 | 509 | 466 | 43 | 9.5 | 67.7 | 0.84 | 0.74 | 0.81 | 0.57 | 0.50 |
| B10 | 506 | 471 | 35 | 7.0 | 49.6 | 1.14 | 1.05 | 0.81 | 0.56 | 0.52 |
| B11 | 506 | 471 | 35 | 5.2 | 37.1 | 1.13 | 1.05 | 0.81 | 0.42 | 0.39 |
| B12 | 521 | 457 | 64 | 5.5 | 39.1 | 1.32 | 1.22 | 0.81 | 0.51 | 0.48 |
| B13 | 521 | 457 | 64 | 8.1 | 57.6 | 1.01 | 0.94 | 0.81 | 0.58 | 0.54 |
| B14 | 479 | 460 | 19 | 7.3 | 51.8 | 0.55 | 0.41 | 1.11 | 0.28 | 0.21 |
| B15 | 479 | 460 | 19 | 10.7 | 75.8 | 0.46 | 0.29 | 1.10 | 0.35 | 0.22 |
| B16 | 460 | 471 | −11 | 4.3 | 30.7 | 0.66 | 0.56 | 1.11 | 0.20 | 0.17 |
| B17 | 460 | 471 | −11 | 7.1 | 50.5 | 0.47 | 0.32 | 1.11 | 0.24 | 0.16 |
| B18 | 460 | 460 | 0 | 7.2 | 50.9 | 0.48 | 0.32 | 1.11 | 0.24 | 0.16 |
| B19 | 460 | 460 | 0 | 4.6 | 32.6 | 0.79 | 0.65 | 1.11 | 0.26 | 0.21 |
| Mean | 494 | 466 | 28 | 7.4 | 52.9 | 0.83 | 0.42 | 0.70 | 0.35 | 0.91 |
| Max | 536 | 478 | 64 | 11.4 | 80.6 | 1.61 | 0.68 | 1.46 | 0.59 | 1.11 |
| Min | 457 | 456 | −11 | 4.3 | 30.7 | 0.43 | 0.20 | 0.20 | 0.15 | 0.81 |

*) remainder Zn and unavoidable impurities and optionally in total up to 0.8% of one or more elements from the group Pb, Bi, Cd, Ti, B, Si, Cu, Ni, Co, Cr, Mn, Sn and rare earths, remainder zinc and unavoidable impurities, wherein the corrosion protection coating has an Al content of maximum 0.5 wt. % in an intermediate layer extending between a surface layer directly adjacent to the surface of the flat steel product and a border layer adjacent to the steel substrate and with a thickness amounting to at least 20% of the total thickness of the corrosion protection coating.

2. The flat steel product of claim 1 wherein the Al content of the intermediate layer is less than 0.25 wt. %.

3. The flat steel product of claim 1 wherein the thickness of the intermediate layer is at least 25% of the total thickness of the corrosion protection coating.

4. The flat steel product of claim 1 wherein the thickness of the surface layer amounts to less than 10% of the total thickness of the corrosion protection coating.

5. The flat steel product of claim 4 wherein the thickness of the surface layer is less than 1% of the total thickness of the corrosion protection coating.

6. The flat steel product of claim 1 wherein the Fe content of the corrosion protection coating amounts to more than 0.5 wt. %.

7. The flat steel product of claim 1 wherein the Al content of the corrosion protection coating is less than 0.6 wt. %.

8. The flat steel product of claim 7 wherein the Al content of the corrosion protection coating is less than 0.5 wt, %.

9. The flat steel product of claim 1 wherein the total thickness of the corrosion protection coating is at least 2.5 μm.

10. The flat steel product of claim 9 wherein the total thickness of the corrosion protection coating is at least 5 μm.

11. The flat steel product of claim 1 wherein the coating mass distribution of the corrosion protection coating is at least 17.5 $g/m^2$.

12. The flat steel product of claim 1 wherein the steel substrate comprises a strip or sheet steel.

13. The flat steel product of claim 1, wherein the coating consists of in (wt. %):

Mg: 0.25 to 2.5%

Al: 0.2 to 3.0%

Fe: 0.3 to 4.0% and optionally in total up to 0.8% of one or more elements from the group Bi, Cd, Ti, B, Si, Cu, Ni, Co, Cr, Mn, Sn and rare earths, remainder zinc and unavoidable impurities.

14. The flat steel product of claim 1, wherein the Fe content of the corrosion protection coating amounts to more than 0.4 wt. %.

15. A method for producing a flat steel product, comprising:

annealing a steel substrate at an annealing temperature; cooling the steel substrate from the annealing temperature to a strip inlet temperature of 400 to 600° C.;

disposing the steel substrate in a melt bath containing (in wt. %) 0.1 to 0.4% Al, 0.25 to 2.5% Mg, up to 0.2% Fe, remainder zinc and unavoidable impurities and heated to a bath temperature of 420 to 500° C., where the difference between the strip immersion temperature and the bath temperature varies in the range from +1° C. to +100° C. so that on the steel substrate a corrosion protection coating is formed which contains (in wt. %);

Mg: 0.25 to 2.5%

Al: 0.2 to 3.0%

Fe: 0.3 to 4.0% and optionally in total up to 0.8% of one or more elements of the group Pb, Bi, Cd, Ti, B, Si, Cu, Ni, Co, Cr, Mn, Sn and rare earths, remainder zinc and unavoidable impurities, further comprising an Al content of maximum 0.5 wt. % in an intermediate layer extending between a surface layer directly adjacent to the surface of the flat steel product and a border layer adjacent to the steel substrate and with a thickness amounting to at least 20% of the total thickness of the corrosion protection coating.

16. The method of claim 15 wherein the bath temperature is 440 to 480° C.

17. The method of claim 15 wherein the difference between the strip immersion temperature and the bath temperature varies in the range from +1° C. to +70° C.

18. The method of claim 15 wherein the strip inlet temperature is 410 to 510° C. and wherein the difference between the strip immersion temperature and the bath temperature varies in the range from +1° C. to +90° C.

19. The method of claim 15 wherein the Fe content of the melt bath is ≦0.1 wt. %.

20. The method of claim 15 wherein the steel substrate comprises a strip or sheet steel.

21. The method of claim 15, wherein the Al in the melt bath is 0.1 to 0.2%.

* * * * *

UNITED STATES PATENT AND TRADEMARK OFFICE

CERTIFICATE OF CORRECTION

PATENT NO. : 8,481,172 B2
APPLICATION NO. : 12/300968
DATED : July 9, 2013
INVENTOR(S) : Warnecke et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 955 days.

Signed and Sealed this
Eighth Day of September, 2015

Michelle K. Lee

Michelle K. Lee
*Director of the United States Patent and Trademark Office*